US005346221A

United States Patent [19]

Gray

[11] Patent Number: 5,346,221

[45] Date of Patent: Sep. 13, 1994

[54] COLOR AND NUMBER GAME APPARATUS

[76] Inventor: Gladys E. Gray, 14255 Lewis Rd., Clio, Mich. 48420

[21] Appl. No.: 172,926

[22] Filed: Dec. 27, 1993

[51] Int. Cl.[5] ..... A63F 3/00

[52] U.S. Cl. ..... 273/243

[58] Field of Search ..... 273/236, 242, 243, 248, 273/249, 282.1

[56] References Cited

U.S. PATENT DOCUMENTS

| | | | |
|---|---|---|---|
| 3,452,989 | 7/1969 | Jernstrom . | |
| 3,866,348 | 2/1975 | Roby et al. . | |
| 3,895,805 | 7/1975 | Enos . | |
| 4,139,199 | 2/1979 | Drummond | 273/243 |
| 4,147,358 | 4/1979 | Erickson | 273/243 X |
| 4,157,183 | 6/1979 | Meyer et al. | 273/243 |
| 4,387,897 | 6/1983 | Andersen . | |
| 4,940,235 | 7/1990 | Martin | 273/243 X |
| 5,009,430 | 4/1991 | Yahasz | 273/243 X |
| 5,066,015 | 11/1991 | Sumrall . | |
| 5,131,663 | 7/1992 | Klein | 273/243 X |
| 5,240,255 | 8/1993 | Barlow | 273/243 |

FOREIGN PATENT DOCUMENTS

| | | | |
|---|---|---|---|
| 2213392 | 8/1989 | United Kingdom | 273/243 |

*Primary Examiner*—William E. Stoll

[57] ABSTRACT

A new and improved color and number game apparatus includes a board assembly which includes a central portion adapted to receive a simulated snapping turtle assembly. The board assembly includes a plurality of numbered pairs of simulated butterfly-wing-receiving portions arrayed circumferentially around the simulated snapping turtle assembly. A simulated snapping turtle assembly includes a simulated turtle shell housing assembly and a simulated head member. The simulated snapping turtle assembly is adapted to be received by the central portion of the board assembly. A plurality of colored simulated butterfly wing assemblies are adapted to be placed upon the numbered pairs of simulated butterfly-wing-receiving portions of the board assembly. A chance selection device, operated by a player, is provided for selecting a number that corresponds to a numbered pair. The simulated butterfly-wing-receiving portions on the board assembly are comprised of indicia which depict simulated butterfly wings and a simulated butterfly body. The simulated butterfly-wing-receiving portions of the board assembly include first connectors for receiving complimentary second connectors on the colored simulated butterfly wing assemblies which are placed on the simulated butterfly-wing-receiving portions.

10 Claims, 2 Drawing Sheets

FIG. 1
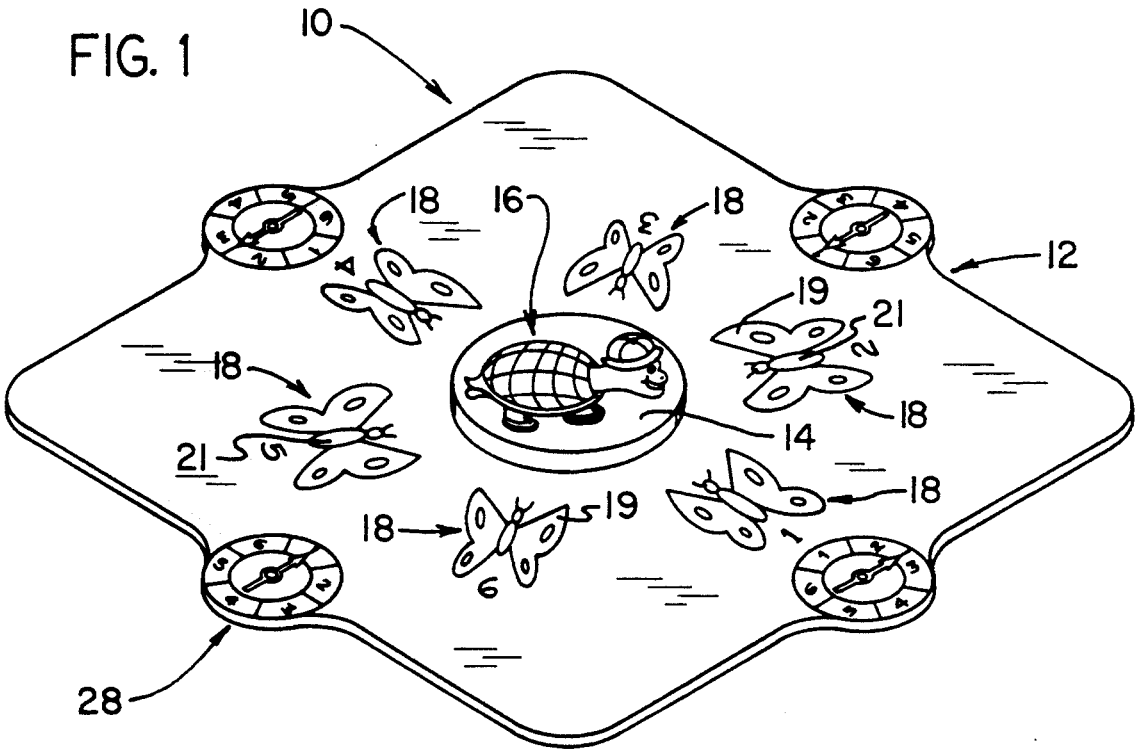
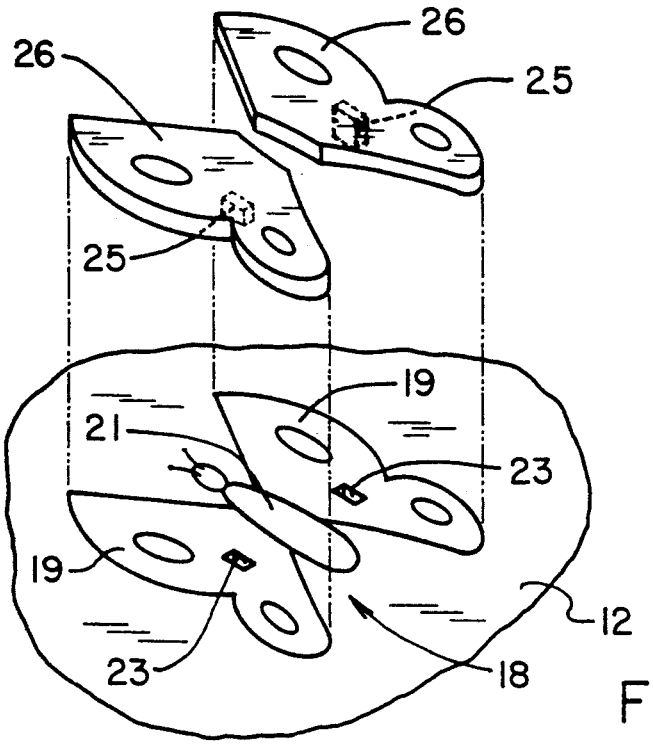
FIG. 2

COLOR AND NUMBER GAME APPARATUS

BACKGROUND OF THE INVENTION

1. Field of the Invention

The present invention relates generally to board games and, more particularly, to a board game especially designed to be played by young children for teaching colors and numbers.

2. Description of the Prior Art

In educating young children, it has been learned that many children learn well when they are having fun during the educational process. In this vein, games have been developed which educate children at the same time they are having fun playing the game. In addition, the process of game playing provides another dimension to the child's education. Game playing gives the child experience in social relationships as well as an increased understanding of the educational content the game conveys.

In appealing to young children, animals, both real and imaginary, are often used to gain the child's interest. Certain animals have consistently appealed to many children over the years, and the turtle and the butterfly are two of such animals. A turtle has a number of fascinating characteristics. The turtle carries its home around with it. The turtle can retract its head and limbs into its shell; and the turtle can often snap its mouth in the process of eating. In this respect, it would be desirable if an educational board game were provided which included a turtle as an important element in the game.

A butterfly is interesting because of its ability to fly and because of its intricate and colorful beauty. In this respect, it would be desirable if an educational board game were provided which included a butterfly as an important element in the game.

A well known relationship can exist between a turtle and a butterfly. This relationship is that of predator and prey. The butterfly may be food for the turtle. The concept of predator and prey is an important concept to learn in the educational process. In this respect, it would be desirable if an educational board game were provided which teaches the concept of predator and prey.

There are many categories of educational material for a child. Two educational categories that are of special interest for small children are colors and numbers. In this respect, it would be desirable if an educational board game were provided which assists in the child's education with respect to colors and numbers.

Yet another important concept for a child to learn is when to wait and when to take one's turn. In this respect, it would be desirable if an educational board game were provided which requires a child to wait and then take one's turn.

Yet another important educational concept for a child to learn is the concept of chance. In this respect, it would be desirable if an educational board game were provided which includes the element of chance in the game.

A game generally has a winner and one or more losers. In progressing in the game, a player can often perceive an incremental approach to the goal of winning. Similarly, other players can often perceive who is losing the game. This skill in predicting a win or a loss is an important skill that is analogous to goal-setting and monitoring one's behavior to attain the goal. In this respect, it would be desirable if an educational board game were provided which gives the participants an opportunity to see a player's incremental approach to winning or losing the game.

Still other features would be desirable in a color and number game apparatus. For example, in a color and number game apparatus that employs a figure of a snapping turtle, it would be desirable if the snapping turtle figure exhibited a simulated snapping action. In a game involving chance, one chance selection device may be employed for all the players. However, it may be desirable if each player had one's own chance selection device.

Board games often have boards that bear indicia that relate to various aspects of the game. Often a movable game piece is placed upon an indicia on the board. However, if the board is jostled inadvertently, the movable game piece may move off of the board indicia. In this respect, it would be desirable if an educational board game were provided which included a movable piece that locks into a structure on the board to prevent movement of the piece along the surface of the board.

Throughout the years, a number of innovations have been developed relating to children's games, and the following U.S. patents are representative of some of those innovations: U.S. Pat. Nos. 3,452,989; 3,866,348; 3,895,805; 4,387,897; and 5,066,015. More specifically, U.S. Pat. No. 3,452,989 discloses a chance-controlled construction game apparatus. U.S. Pat. No. 3,895,805 discloses a game having a theme of items of clothing placed on a clothes line. U.S. Pat. No. 4,387,897 discloses a game in which a pyramid is constructed. U.S. Pat. No. 5,066,015 discloses a game having a railroad theme. U.S. Pat. No. 3,866,348 does not disclose a game, but it may be of interest for its disclosure of a toy insect that can be disassembled and reassembled.

Thus, while the foregoing body of prior art indicates it to be well known to use games to teach educational concepts, the prior art described above does not teach or suggest a color and number game apparatus which has the following combination of desirable features: (1) includes a snapping turtle as an important element in the game; (2) includes a butterfly as an important element in the game; (3) teaches the concept of predator and prey; (4) assists in the child's education with respect to colors and numbers; (5) requires a child to wait and then take one's turn; (6) includes the element of chance in the game; (7) gives the participants an opportunity to see a player's incremental approach to winning or losing the game; (8) provides a turtle with a simulated snapping action; (9) provides each player with one's own chance selection device; and (10) includes a movable piece that locks into a complementary structure on the board to prevent movement of the piece along the surface of the board.

The foregoing desired characteristics are provided by the unique color and number game apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved color and number game apparatus includes a board assembly which includes a central portion adapted to receive a simulated snapping turtle assembly. The board assembly includes a plurality of numbered pairs of simulated butterfly-wing-receiving portions arrayed circumferentially around the simulated snapping turtle assembly. A simulated snapping turtle assembly includes a simulated turtle shell housing assembly and a simulated head member. The simulated snapping turtle assembly is adapted to be received by the central portion of the board assembly. A plurality of colored simulated butterfly wing assemblies are adapted to be placed upon the numbered pairs of simulated butterfly-wing-receiving portions of the board assembly. A chance selection device, operated by a player, is provided for selecting a number that corresponds to a numbered pair.

The simulated butterfly-wing-receiving portions on the board assembly are comprised of indicia which depict simulated butterfly wings and a simulated butterfly body. The simulated butterfly-wing-receiving portions of the board assembly include first connectors for receiving complimentary second connectors on the colored simulated butterfly wing assemblies which are placed on the simulated butterfly-wing-receiving portions. The chance selection device includes a spinner assembly. The chance selection device includes a circular array number-beating indicia located on the board assembly, a pointed spinner arrow, and a spinner bearing assembly, centrally located within the circular array number-bearing indicia and supported by the board assembly. The spinner bearing assembly receives the pointed spinner arrow and permits the pointed spinner arrow to spin when moved by a person.

The simulated snapping turtle assembly includes a movable simulated head assembly supported by the simulated turtle shell housing assembly. A hand-operated actuator assembly is supported by the simulated turtle shell housing assembly and is connected to the movable simulated head assembly, for operating the movable simulated head assembly. The movable simulated head assembly includes a simulated turtle head member. A first lever arm supports the simulated turtle head member. A second lever arm is connected to the first lever arm. A first pivot assembly is supported by the simulated turtle shell housing assembly and is connected between the first lever arm and the second lever arm. The first pivot assembly permits the simulated turtle head member to rise and fall as the first lever arm pivots around the first pivot assembly. The hand-operated actuator assembly includes an actuator arm adapted for actuating the second lever arm of the movable simulated head assembly. A hand-operated handle member is attached to the actuator arm, and a second pivot assembly is connected to the simulated turtle shell housing assembly. The second pivot assembly supports the actuator arm and the hand-operated handle member, such that when the hand-operated handle member is pressed by a person, the actuator arm is actuated, whereby the second lever arm of the movable simulated head assembly is moved by the actuator arm, whereby the first lever arm of the movable simulated head assembly is moved by the second lever arm, and whereby the first lever arm moves the simulated turtle head member providing a simulated snapping motion.

The actuator arm includes a pin. The second lever arm includes a guide slot for receiving the pin, such that the pin rides in the guide slot when the actuator arm moves the second lever arm. Simulated turtle feet are connected to the simulated turtle shell housing assembly.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved color and number game apparatus which has all of the advantages of the prior art and none of the disadvantages.

It is another object of the present invention to provide a new and improved color and number game apparatus which may be easily and efficiently manufactured and marketed.

It is a further object of the present invention to provide a new and improved color and number game apparatus which is of durable and reliable construction.

An even further object of the present invention is to provide a new and improved color and number game apparatus which is susceptible of a low cost of manufacture with regard to both materials and labor, and which accordingly is then susceptible of low prices of sale to the consuming public, thereby making such color and number game apparatus available to the buying public.

Still yet a further object of the present invention is to provide a new and improved color and number game apparatus which includes a snapping turtle as an important element in the game.

Still another object of the present invention is to provide a new and improved color and number game apparatus that includes a butterfly as an important element in the game.

Yet another object of the present invention is to provide a new and improved color and number game apparatus which teaches the concept of predator and prey.

Even another object of the present invention is to provide a new and improved color and number game apparatus that assists in the child's education with respect to colors and numbers.

Still a further object of the present invention is to provide a new and improved color and number game apparatus which requires a child to wait and then take one's turn.

Yet another object of the present invention is to provide a new and improved color and number game apparatus that includes the element of chance in the game.

Still another object of the present invention is to provide a new and improved color and number game apparatus which gives the participants an opportunity to see a player's incremental approach to winning or losing the game.

Yet another object of the present invention is to provide a new and improved color and number game apparatus that provides a turtle with a simulated snapping action.

Still a further object of the present invention is to provide a new and improved color and number game apparatus that provides each player with one's own chance selection device.

Yet another object of the present invention is to provide a new and improved color and number game apparatus which includes a movable piece that locks into a complementary structure on the board to prevent movement of the piece along the surface of the board.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated at least one preferred embodiment of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a perspective view showing a first preferred embodiment of the color and number game apparatus of the invention which includes a snapping turtle and butterflies.

FIG. 2 is an enlarged exploded view of a pair of butterfly wings of the embodiment in FIG. 1 ready to be placed on the board.

DESCRIPTION OF THE PREFERRED EMBODIMENT

With reference to the drawings, a new and improved color and number game apparatus embodying the principles and concepts of the present invention will be described.

Figure 3:
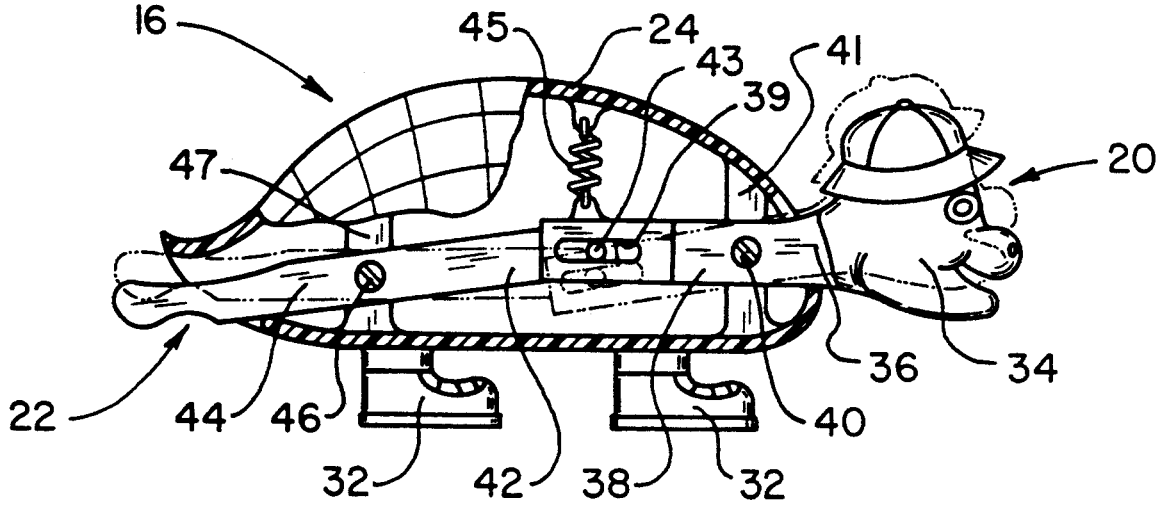
FIG. 3 is an enlarged, partial broken away view, and partial cross-sectional view of the snapping turtle shown in the embodiment of FIG. 1.
Figure 4:
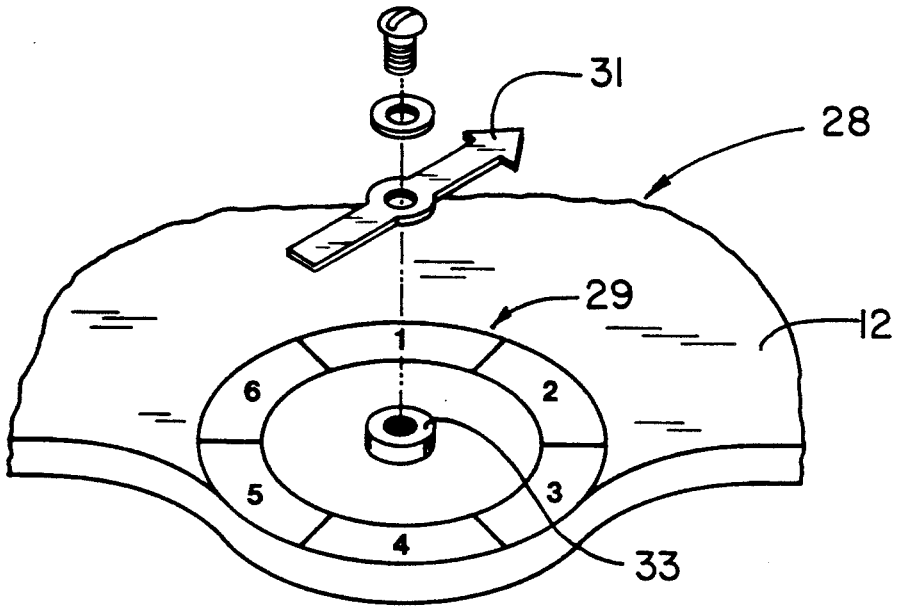
FIG. 4 is an enlarged, partially exploded perspective view of a chance selection device in the form of a spinner in the embodiment shown in FIG. 1.

Turning initially to FIGS. 1–4, there is shown an exemplary embodiment of the color and number game apparatus of the invention generally designated by reference numeral 10. In its preferred form, the color and number game apparatus 10 includes a board assembly 12 which includes a central portion 14 adapted to receive a simulated snapping turtle assembly 16. The board assembly 12 includes a plurality of numbered pairs of simulated butterfly-wing-receiving portions 18 arrayed circumferentially around the simulated snapping turtle assembly 16. A simulated snapping turtle assembly 16 includes a simulated turtle shell housing assembly 24 and a simulated head member 20. The simulated snapping turtle assembly 16 is adapted to be received by the central portion 14 of the board assembly 12. A plurality of colored simulated butterfly wing assemblies 26 are adapted to be placed upon the numbered pairs of simulated butterfly-wing-receiving portions 18 of the board assembly 12. A chance selection device 28, operated by a player, is provided for selecting a number that corresponds to a numbered pair.

The simulated butterfly-wing-receiving portions 18 on the board assembly 12 are comprised of indicia which depict simulated butterfly wings 19 and a simulated butterfly body 21. The simulated butterfly-wing-receiving portions 18 of the board assembly 12 include first connectors 23 for receiving complimentary second connectors 25 on the colored simulated butterfly wing assemblies 26 which are placed on the simulated butterfly-wing-receiving portions 18. The first connectors 23 are in the form of wells 23 in the board assembly 12. The complimentary second connectors 25 are in the form of small protuberances 25 that project from the bottom of the colored simulated butterfly wing assemblies 26. When the complimentary second connectors 25 are in the first connectors 23, the colored simulated butterfly wing assemblies 26 are secured to the simulated butterfly-wing-receiving portions 18 on the board assembly 12.

The chance selection device 28 includes a spinner assembly 28. Alternatively, the chance selection device 28 can be a six-sided die. The chance selection device 28 includes a circular array of number-bearing indicia 29 located on the board assembly 12, a pointed spinner arrow 31, and a spinner bearing assembly 33, centrally located within the circular array of number-bearing indicia 29 and supported by the board assembly 12. The spinner bearing assembly 33 receives the pointed spinner arrow 31 and permits the pointed spinner arrow 31 to spin when moved by a person.

The simulated snapping turtle assembly 16 includes a movable simulated head assembly 20 supported by the simulated turtle shell housing assembly 24. A hand-operated actuator assembly 22 is supported by the simulated turtle shell housing assembly 24 and is connected to the movable simulated head assembly 20, for operating the movable simulated head assembly 20. The movable simulated head assembly 20 includes a simulated turtle head member 34. A first lever arm 36 supports the simulated turtle head member 34. A second lever arm 38 is connected to the first lever arm 36. A first pivot assembly 40 is supported by the simulated turtle shell housing assembly 24 and is connected between the first lever arm 36 and the second lever arm 38. The first pivot assembly 40 permits the simulated turtle head member 34 to rise and fall as the first lever arm 36 pivots around the first pivot assembly 40. The first pivot assembly 40 is connected to a first strut 41 that is supported by the simulated turtle shell housing assembly 24. The hand-operated actuator assembly 22 includes an actuator arm 42 adapted for actuating the second lever arm 38 of the movable simulated head assembly 20. A hand-operated handle member 44 is attached to the actuator arm 42, and a second pivot assembly 46 is connected to the simulated turtle shell housing assembly 24. The second pivot assembly 46 supports the actuator ann 42 and the hand-operated handle member 44, such that when the hand-operated handle member 44 is pressed by a person, the actuator arm 42 is actuated, whereby the second lever arm 38 of the movable simulated head assembly 20 is moved by the actuator arm 42, whereby the first lever arm 36 of the movable simulated head assembly 20 is moved by the second lever arm 38, and whereby the first lever arm 36 moves the simulated turtle head member 34 providing a simulated snapping motion. The second pivot assembly 46 is connected to a second strut 47 that is supported by the simulated turtle shell housing assembly 24.

The actuator arm 42 includes a pin 43. The second lever arm 38 includes a guide slot 39 for receiving the pin 43, such that the pin 43 rides in the guide slot 39 when the actuator arm 42 moves the second lever arm. 38. A spring 45 has one end connected to the simulated turtle shell housing assembly 24, and the other end is connected to the actuator arm 42. The spring 45 urges the actuator arm 42 upward whereby the pin 43 urges the second lever arm 38 upward. Pivoting on the first pivot assembly 40, the first lever arm 36 and the simulated turtle head member 34 move downward when the second lever arm 38 moves upward. When the hand-operated handle member 44 is pushed upward, the actuator arm 42 moves downward around the second pivot assembly 46. The hand-operated handle member 44 can be pushed up when one of a person's fingers is placed on the hand-operated handle member 44, another of the person's fingers is placed on the outside of the simulated turtle shell housing assembly 24, and the provides a squeezing action between the two fingers. The pin 43 pushes the second lever arm 38 downward, and the first lever arm 36 and the simulated turtle head member 34 move upward around the first pivot assembly 40.

When the hand-operated handle member 44 is released, the spring 45 pulls the actuator arm 42 upward, and the hand-operated handle member 44 moves downward. As the actuator arm 42 is pulled upward, the pin 43 moves the second lever arm 38 upward around the first pivot assembly 40, and the first lever arm 36 and the simulated turtle head member 34 move downward to their initial position. Simulated turtle feet 32 are connected to the simulated turtle shell housing assembly 24.

In employing the color and number game apparatus 10 of the invention, a number of games can be played. For example, a game can be played by 2 to 4 players. There are six simulated butterfly-wing-receiving portions 18, and there are six pairs of colored simulated butterfly wing assemblies 26. Each of the six pairs of the colored simulated butterfly wing assemblies 26 are in a different color. In addition, each of the six pairs of simulated butterfly-wing-receiving portions 18 is associated with a number from 1 to 6. Thus, the game can be used as an educational game for children for teaching colors and numbers. In variations of the game, more colors and more numbers can be used.

In playing the game, the chance selection device 28 (e.g. a spinner or single die) is activated to select a number from 1 to 6 by chance. The player with the highest number is first and chooses a number from 1 to 6 to get bit by the simulated snapping turtle assembly 16. The player activates the chance selection device 28 again and places a colored simulated butterfly wing assembly 26 on a simulated butterfly-wing-receiving portion 18 whose associated number corresponds to the chance selected number. Each of the simulated butterfly-wing-receiving portions 18 can be color coded. In addition the simulated buttertly wing assemblies 26 are also color coded. For example, the number 6 simulated butterfly-wing-receiving portions 18 can be orange. Thus, when a number 6 is selected by the chance selection device 28, the player places an orange, colored simulated butterfly wing assembly 26 on one of the orange simulated butterfly-wing-receiving portions 18 associated with the number 6.

If the number that is selected by chance matches the number chosen for biting by the simulated snapping turtle assembly 16, while the colored simulated butterfly wing assembly 26 is placed on the respective simulated butterfly-wing-receiving portion 18, the simulated snapping turtle assembly 16 is grabbed by the opposite player and bites the colored simulated butterfly wing assembly 26. If there are more than two players, whichever player picks of the simulated snapping turtle assembly 16 first gets to bite the respective simulated snapping turtle assembly 16. In order of player, the player on the left has the next turn with the chance selection device 28. The game ends when the last colored simulated butterfly wing assembly 26 is placed on a respective simulated butterfly-wing-receiving portion 18. The first person to complete the set of colored simulated butterfly wing assemblies 26 on their respective simulated buttertly-wing-receiving portions 18 is the winner.

The components of the color and number game apparatus of the invention can be made from inexpensive and durable plastic materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved color and number game apparatus that is low in cost, relatively simple in design and operation, and which includes a snapping turtle as an important element in the game. With the invention, a color and number game apparatus is provided which includes a butterfly as an important element in the game. With the invention, a color and number game apparatus is provided which teaches the concept of predator and prey. With the invention, a color and number game apparatus is provided which assists in the child's education with respect to colors and numbers. With the invention, a color and number game apparatus is provided which requires a child to wait and then take one's turn. With the invention, a color and number game apparatus is provided which includes the element of chance in the game. With the invention, a color and number game apparatus is provided which gives the participants an opportunity to see a player's incremental approach to winning or losing the game.

With the invention, a color and number game apparatus is provided which provides a turtle with a simulated snapping action. With the invention, a color and number game apparatus is provided which provides each player with one's own chance selection device. With the invention, a color and number game apparatus is provided which includes a movable piece that locks into a complementary structure on the board to prevent movement of the piece along the surface of the board.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved color and number game apparatus, comprising:

a board assembly which includes a central portion adapted to receive a simulated snapping turtle assembly, said board assembly including a plurality of numbered pairs of simulated butterfly-wing-receiving portions arrayed circumferentially around said simulated snapping turtle assembly, a simulated snapping turtle assembly which includes a simulated turtle shell housing assembly and a simulated head member, said simulated snapping turtle assembly adapted to be received by said central portion of said board assembly, a plurality of separate, colored pairs of simulated butterfly wing assemblies adapted to be placed upon said numbered pairs of simulated butterfly-wing-receiving portions of said board assembly, and a chance selection device, operated by a player, for selecting a number that corresponds to a numbered pair of said simulated butterfly-wing-receiving portions of said board assembly.

2. The apparatus described in claim 1 wherein said simulated butterfly-wing-receiving portions on said board assembly are comprised of indicia which depict simulated butterfly wings and a simulated butterfly body.

3. The apparatus described in claim 1 wherein said simulated butterfly-wing-receiving portions of said board assembly include first connectors for receiving complimentary second connectors on said colored simulated butterfly wing assemblies which are placed on said simulated butterfly-wing-receiving portions.

4. The apparatus described in claim 1 wherein said chance selection device includes a spinner assembly.

5. The apparatus described in claim 4 wherein said chance selection device includes:

a circular array of number-bearing indicia located on said board assembly, a pointed spinner arrow, and a spinner bearing assembly, centrally located within said circular array of number-beating indicia and supported by said board assembly, for receiving said pointed spinner arrow and permitting said pointed spinner arrow to spin when moved by a person.

6. The apparatus described in claim 1 wherein said simulated snapping turtle assembly includes:

a movable simulated head assembly supported by said simulated turtle shell housing assembly, and a hand-operated actuator assembly, supported by said simulated turtle shell housing assembly and connected to said movable simulated head assembly, for operating said movable simulated head assembly.

7. The apparatus described in claim 6 wherein said movable simulated head assembly includes:

a simulated turtle head member, a first lever arm supporting said simulated turtle head member, a second lever arm connected to said first lever arm, and a first pivot assembly, supported by said simulated turtle shell housing assembly, connected between said first lever arm and said second lever arm, said first pivot assembly permitting said simulated turtle head member to rise and fall as said first lever arm pivots around said first pivot assembly.

8. The apparatus described in claim 7 wherein said hand-operated actuator assembly includes:

an actuator arm adapted for actuating said second lever arm of said movable simulated head assembly, a hand-operated handle member attached to said actuator arm, and a second pivot assembly, connected to said simulated turtle shell housing assembly, for supporting said actuator arm and said hand-operated handle member, such that when said hand-operated handle member is pressed by a person, said actuator arm is actuated, whereby said second lever arm of said movable simulated head assembly is moved by said actuator arm, whereby said first lever arm of said movable simulated head assembly is moved by said second lever arm, and whereby said first lever arm moves said simulated turtle head member.

9. The apparatus described in claim 8 wherein:

said actuator arm includes a pin, and said second lever arm includes a guide slot for receiving said pin, such that said pin rides in said guide slot when said actuator arm moves said second lever arm.

10. The apparatus described in claim 1 further including simulated turtle feet connected to said simulated turtle shell housing assembly.

* * * * *